US006305204B1

(12) United States Patent
Tauzer

(10) Patent No.: US 6,305,204 B1
(45) Date of Patent: Oct. 23, 2001

(54) BULGE FORMING MACHINE

(75) Inventor: Paul J. Tauzer, Petosky, MI (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/615,164

(22) Filed: Jul. 13, 2000

(51) Int. Cl.[7] ..... B21D 26/02
(52) U.S. Cl. ..... 72/62; 72/61; 29/421.1
(58) Field of Search ..... 72/54, 58, 61, 72/62; 29/421.1

(56) References Cited

U.S. PATENT DOCUMENTS

| | | | | |
|---|---|---|---|---|
| 3,487,668 | * | 1/1970 | Fuchs, Jr. | 72/58 |
| 4,282,734 | * | 8/1981 | Eddy | 72/54 |
| 4,384,840 | | 5/1983 | Desplanches et al. . | |
| 4,418,556 | * | 12/1983 | Galle et al. | 72/62 |
| 4,449,281 | | 5/1984 | Yoshida et al. . | |
| 4,502,308 | * | 3/1985 | Kelly | 72/58 |
| 4,590,655 | | 5/1986 | Javorik . | |
| 4,840,053 | | 6/1989 | Nakamura . | |
| 4,875,270 | | 10/1989 | Krips et al. . | |
| 5,214,948 | | 6/1993 | Sanders et al. . | |
| 5,419,171 | | 5/1995 | Bumgarner . | |
| 5,435,163 | | 7/1995 | Schäfer . | |
| 5,485,737 | | 1/1996 | Dickerson . | |
| 5,630,334 | | 5/1997 | Ash . | |
| 5,649,439 | | 7/1997 | Schulz . | |
| 5,715,718 | | 2/1998 | Rigsby et al. . | |
| 5,813,266 | | 9/1998 | Ash . | |
| 5,826,320 | | 10/1998 | Rathke et al. . | |
| 6,089,064 | | 7/2000 | Tuazer . | |
| 6,128,936 | * | 10/2000 | Yogo | 72/58 |

* cited by examiner

*Primary Examiner*—David Jones
(74) *Attorney, Agent, or Firm*—Harness Dickey & Pierce P.L.C.

(57) ABSTRACT

A forming device having a fluid source for providing a pressurized fluid, a strongback having a die cavity, a tubular workpiece having a hollow interior, a die and a mandrel assembly. The die is formed from a plurality of mated die components and includes an internal cavity which is configured to correspond to a predetermined tube profile. The die is at least partially disposed in the die cavity and surrounds at least a portion of the tubular workpiece. The mandrel assembly is disposed at least partially within the hollow interior of the tubular workpiece in an area proximate the die and is in sealing engagement with the hollow interior of the tubular workpiece. The mandrel assembly includes at least one feed aperture that is in fluid connection with the fluid source. The feed aperture directs the pressurized fluid against the hollow interior of the tubular workpiece to cause the tubular workpiece to expand into the internal cavity. A method for forming a tubular workpiece having a hollow interior is also provided.

20 Claims, 4 Drawing Sheets

BULGE FORMING MACHINE

TECHNICAL FIELD

The present invention relates generally to the forming of bulges in tubular materials and more particularly to a device and method for forming bulges in a relatively inexpensive manner.

BACKGROUND OF THE INVENTION

Background Art

Metal ducts and tubes are routinely incorporated into numerous applications such as automotive vehicles, refrigeration systems and aircraft. Many of these metal ducts and tubes include irregular bends, bulges and/or indentations which can be problematic to form. Ducts and tubes that are relatively straight and that do not have harsh or abrupt bulges or indentations are commonly shaped using conventional bulge forming methods, including hydroforming.

A conventional bulge-forming device consists of an upper platen and a lower platen. A jig collar holds two matching die halves together around a tubular workpiece. A pair of pistons hold the tubular workpiece firmly between the die halves, an incompressible fluid is fed through one of the pistons and air is evacuated from the tubular workpiece from the other piston. When all of the air has been evacuated from the workpiece, a valve is closed permitting pressure to build up within the workpiece and causing the workpiece to bulge to match the contour of the die halves.

Conventional bulge forming has several limitations, the most notable of which pertains to its cost. Conventional bulge forming requires a press with relatively high tonnage and high strength tools that will withstand the application of hydraulic pressures of 20,000 p.s.i. or higher. In relatively high volume applications, conventional bulge forming may be a cost-effective alternative to other processes which tend to be more labor intensive. However, in relatively low volume applications, such as commercial aircraft, where only a couple hundred parts may need to be fabricated from a tool, the high cost of the presses and tooling associated with conventional bulge forming are prohibitive.

Other drawbacks of conventional bulge forming methods concern the geometry of the workpiece and the subsequent processing of the formed workpieces. Since pressurized fluid is applied against the interior of the entire workpiece, it remains a practical requirement that the workpiece be relatively straight and/or flat so as to simplify the geometry of the forming dies. Furthermore, it also remains a practical requirement that the workpiece be relatively short so as to avoid problems, such as pump capacity and cycle time, that are typically encountered when applying a high pressure fluid to a relatively large cavity.

One alternative to conventional bulge forming that has been used in low-volume applications has been to form small segments of the tube by hand and welding the segments together. While tooling costs for this method are relatively low, this process is extremely labor intensive and it is rather difficult to control the final quality of the tube or duct.

In commonly assigned U.S. Pat. No. 5,419,171 to Bumgarner, the disclosure of which is hereby incorporated by reference as if fully set forth herein, an improved isostatic bulge forming device and method is disclosed for forming a meal tube. The bulge-forming device employs a fluid pressure chamber having a valved inlet and a valved outlet for entry and egress of a forming fluid. The apparatus also includes a pair of mated tool halves that are retained in a fixturing tube and that collectively define a forming cavity. After the tool halves are sealingly engaged to a tubular workpiece and the workpiece is inserted into the tool, a pair of annular caps are placed in a fluid tight seal with the fixturing tube and the chamber is filled with an incompressible fluid. As pressurized fluid is permitted to travel to the interior of the tubular workpiece but not between the tool halves and the tubular workpiece, the pressurized fluid deforms the tubular workpiece to conform to the forming cavity.

While this method represents a significant advancement in the art for the forming of tubes and ducts on a low-volume basis, several drawbacks have been noted. Like conventional bulge forming methods, these drawbacks concern the geometry of the workpiece. Since pressurized fluid is applied against the interior of the entire workpiece, it remains a practical requirement that the workpiece be relatively straight and/or flat so as to simplify the geometry of the tool halves. Furthermore, it also remains a practical requirement that the workpiece be relatively short so as to avoid problems, such as pump capacity and cycle time, that are typically encountered when applying a high pressure fluid to a relatively large cavity.

Therefore, it would be desirable to provide a forming device for expanding tubular workpieces that provides a high quality formed tube at a relatively low-cost. It would also be highly desirable to provide a method for forming tubular workpieces that is cost-effective for relatively low-volume applications.

SUMMARY OF THE INVENTION

In one preferred form, the present invention provides a forming device having a fluid source for providing a pressurized fluid, a strongback having a die cavity, a tubular workpiece having a hollow interior, a die and a mandrel assembly. The die is formed from a plurality of mated die components and includes an internal cavity which is configured to correspond to a predetermined tube profile. The die is at least partially disposed in the die cavity and surrounds at least a portion of the tubular workpiece. The mandrel assembly is disposed at least partially within the hollow interior of the tubular workpiece in an area proximate the die and is in sealing engagement with the hollow interior of the tubular workpiece. The mandrel assembly includes at least one feed aperture that is in fluid connection with the fluid source. The feed aperture directs the pressurized fluid against the hollow interior of the tubular workpiece to cause the tubular workpiece to expand into the internal cavity. A method for forming a tubular workpiece having a hollow interior is also provided.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENT

Figure 1:
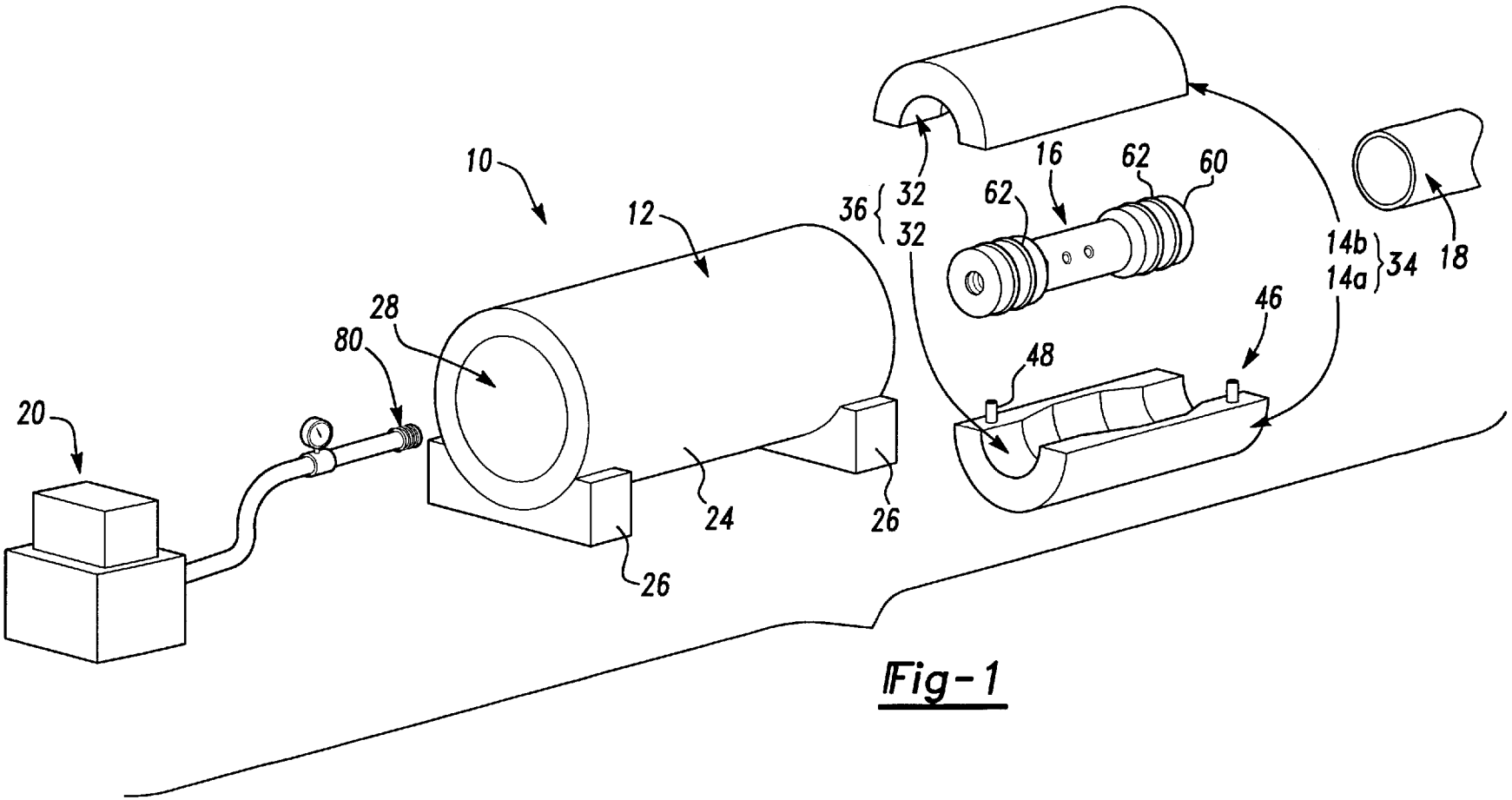
FIG. 1 is an exploded perspective view of a forming device constructed in accordance with the teachings of the present invention in operative association with a tubular workpiece.

With reference to FIG. 1 of the drawings, a forming device constructed in accordance with the teachings of the present invention is generally indicated by reference numeral 10. Forming device 10 is shown to include a strongback 12, a plurality of die components 14, a mandrel assembly 16, a tubular workpiece 18 and a source of pressurized fluid 20.

Strongback 12 is illustrated to have a generally cylindrical body portion 24 with a pair of feet 26 fixedly coupled thereto to prevent body portion 24 from rotating. Body portion 24 is preferably unitarily formed from a high strength material, such as steel and includes a die cavity 28. In the particular embodiment illustrated, die cavity 28 has a circular cross-section that is formed along the longitudinal axis of body portion 24.

Figure 2:
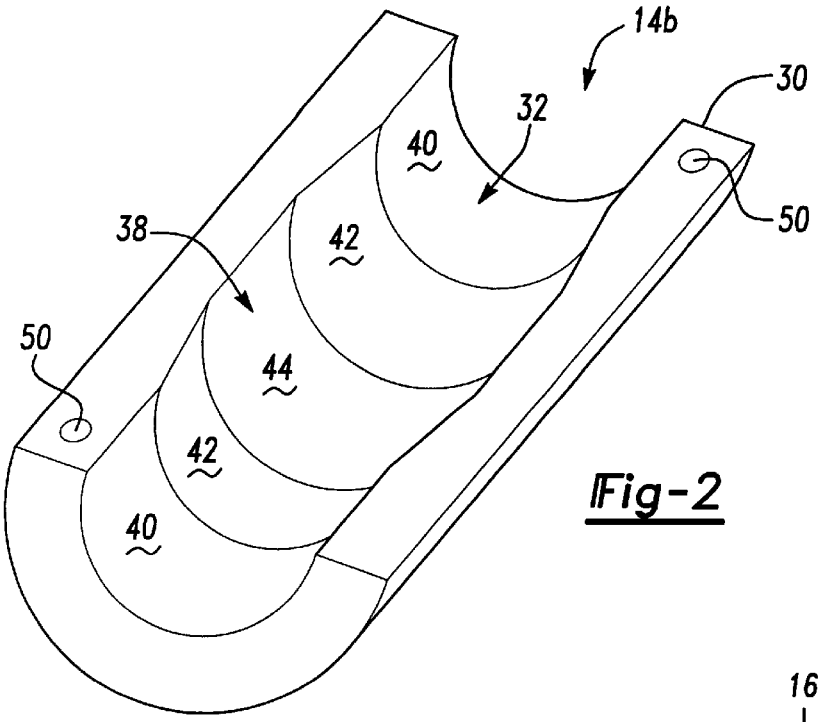
FIG. 2 is a perspective view of one of the forming dies illustrated in FIG. 1.

In the particular embodiment illustrated, the plurality of die components 14 include a lower die component 14*a* and an upper die component 14*b*. With additional reference to FIG. 2, each of the lower and upper die components 14*a* and 14*b* is shown to include a die member 30 having a die aperture 32. Lower and upper die components 14*a* and 14*b* mate to form a die 34 having an internal cavity 36 defined by the die apertures 32 in the die members 30. Internal cavity 36 is configured to correspond to a predetermined tube profile 38. In the example provided, the tube profile 38 includes a pair of first portions 40, a pair of second portions 42 and a third portion 44. Each of the first portions 40 are configured to match the initial or unexpanded diameter of tubular workpiece 18. The second portions 42 taper outwardly toward the third portion 44. Die 34 is sized to engage die cavity 28 in a slip fit manner (i.e., little diametrical clearance exists between die 34 and die cavity 28 but die 34 may freely slide through die cavity 28).

To aid in aligning lower and upper die components 14*a* and 14*b* to one another, an aligning mechanism 46 is be employed. Aligning mechanism 46 may include a pair of pin members 48 and a pair of pin apertures 50. The pair of pin members 48 are coupled to the die member 30 that forms the lower die component 14*a* and the pin apertures 50 are formed into the die member 30 that forms the upper die component 14*b*. Pin members 48 and pin apertures 50 are located in their respective die member 30 such that lower and upper die components 14*a* and 14*b* are aligned to one another when pin members 48 are received into pin apertures 50. As aligning mechanisms 46 are well known in the art, those skilled in the art will understand that other types of aligning mechanisms 46 may similarly be employed and that the scope of the present invention will not be limited to aligning mechanisms of the type illustrated and discussed.

Figure 3:
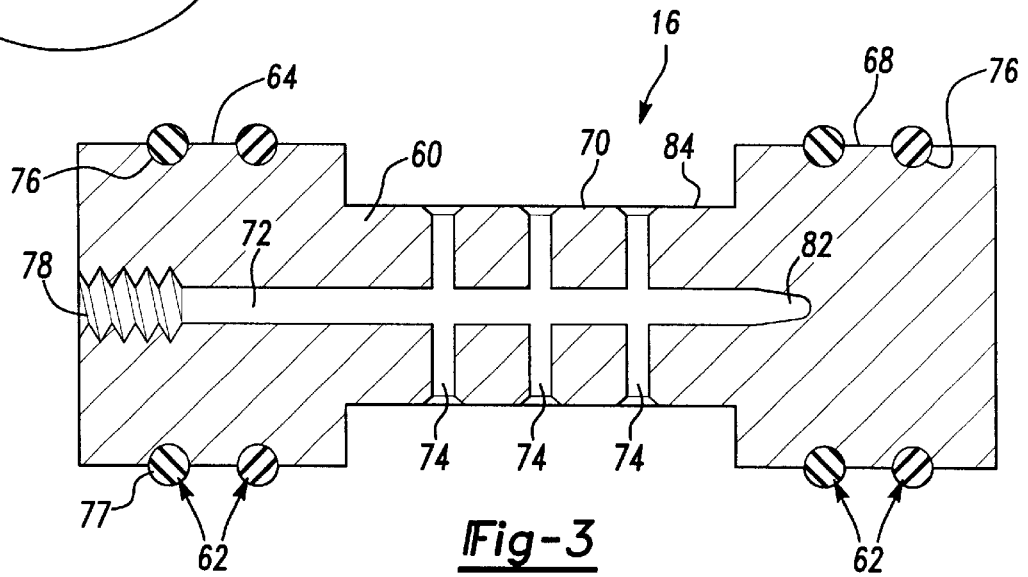
FIG. 3 is a longitudinal cross-sectional view of the mandrel illustrated in FIG. 1.

With reference to FIGS. 1 and 3, mandrel assembly 16 is illustrated to include a mandrel member 60 and a plurality of seal members 62. Mandrel member 60 is preferably unitarily formed from a high strength material such as steel and includes first and second seal portions 64 and 68, respectively, a necked-down portion 70, a feed manifold 72 and a plurality of feed apertures 74. The first and second seal portions 64 and 68 are generally cylindrical in shape and are of a diameter that closely matches the inside diameter of tubular workpiece 18. Each of the first and second seal portions 64 and 68 includes a plurality of seal grooves 76, each of which is adapted to receive one of the seal members 62. In the particular embodiment illustrated, each of the seal members 62 is a conventional O-ring 77 having a generally circular cross-section. Necked-down portion 70 is disposed between the first and second seal portions 64 and 68 has an outer diameter that is smaller than that of the first and second seal portions 64 and 68.

Feed manifold 72 extends through first seal portion 64 and neckeddown portion 70. The open end 78 of feed manifold 72 is threaded to receive an adapter 80 to permit mandrel member 60 to be coupled to the source of pressurized fluid 20. The closed end 82 of feed manifold 72 is preferably rounded to reduce the concentration of stress in mandrel member 60. The plurality of feed apertures 74 are axially spaced along necked-down portion 70 and extend from feed manifold 72 through the surface 84 of necked-down portion 70. The ends of feed apertures 74 are preferably heavily chamfered to reduce the concentration of stress in mandrel member 60.

Figure 4:
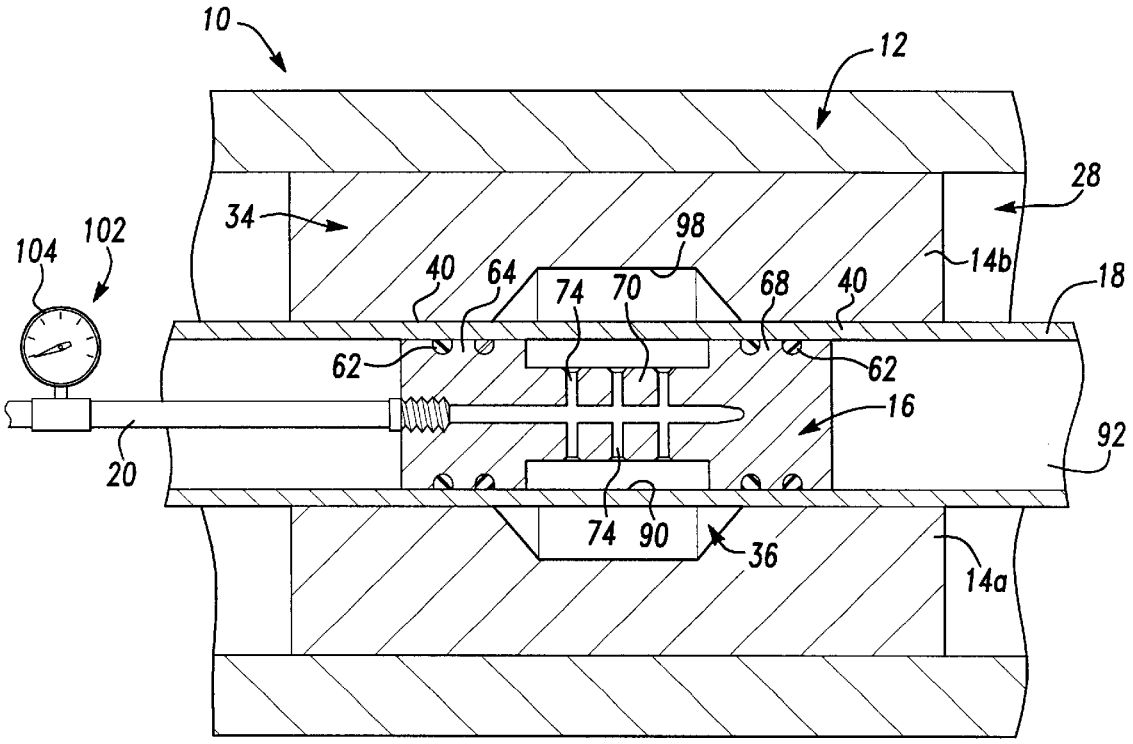
FIG. 4 is a longitudinal cross-sectional side of the forming device of FIG. 1 illustrating the tubular workpiece prior to forming.
Figure 5:
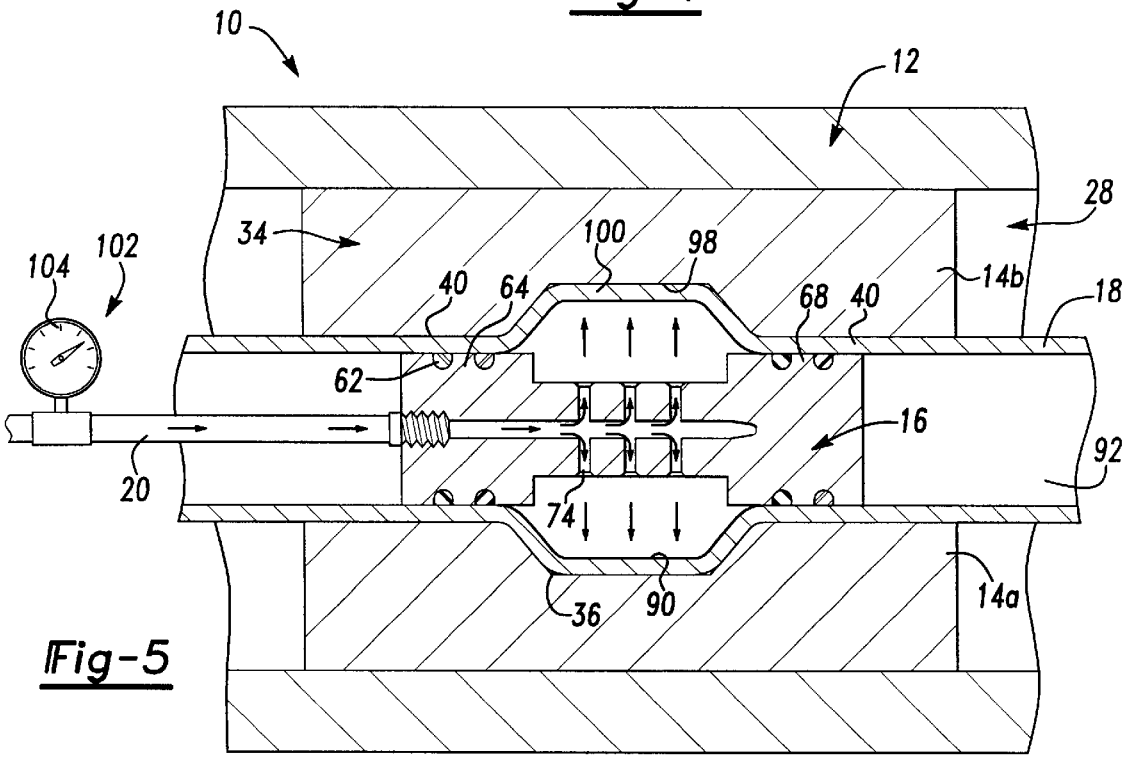
FIG. 5 is a longitudinal cross-sectional view similar to FIG. 4 but illustrating the tubular workpiece after forming.

In operating forming device 10, tubular workpiece 18 is initially placed in the die aperture 32 of lower die component 14*a*. Upper die component 14*b* is aligned to lower die component 14*a* and lowered onto tubular workpiece 18 and lower die component 14*a*. Mandrel assembly 16 is next inserted into tubular workpiece 18 and positioned proximate die 34 as shown in FIG. 4. In this regard, first and second seal portions 64 and 68 of mandrel member 60 are positioned across from the first portions 40 of the tube profile 38 to ensure that seal members 62 will remain in sealing engagement with the surface 90 of the hollow interior 92 of tubular workpiece 18 throughout the forming process. Die 34, tubular workpiece 18 and mandrel assembly 16 are collectively slid into the die cavity 28 in strongback 12.

Depending on the configuration and capacity of the source of pressurized fluid 20, it may be necessary to purge the residual air in the mandrel member 60 and between the tubular workpiece 18 and the necked-down portion 70 of the mandrel member 60 by manually introducing an incompressible fluid through the feed manifold 72 and feed apertures 74. This step may be necessary, for example, when the source of pressurized fluid 20 is a pump with a relatively small displacement, and relatively long cycle times would result if the pump were used to fill the feed manifold 72, feed apertures 74 and the space between the necked-down portion 70 of the mandrel member 60 and the surface 90 of the tubular workpiece 18.

The source of pressurized fluid 20 is coupled to the first end of feed manifold 72 and pressurized fluid is supplied thereto. Pressurized fluid travels through the feed manifold 72 and out of the feed apertures 74 where it exerts a force against the surface 90 of the hollow interior 92 of tubular workpiece 18. When the force exerted by the pressurized fluid exceeds the yield strength of the tubular workpiece 18, the tubular workpiece 18 expands outwardly toward the surface 98 of the internal cavity 36. As the yielding of the tubular workpiece 18 increases the surface area against which the pressurized fluid must act, maintaining the pressure of the pressurized fluid at a predetermined pressure above that which would cause the tubular workpiece 18 to yield for a predetermined time ensures that the formation process is complete (i.e., the tubular workpiece 18 has expanded sufficiently to come into contact with the surface 98 on the internal cavity 36 and form a bulge 100 in the tubular workpiece 18). Accordingly, the source of pressurized fluid 20 preferably includes a pressure measurement device 102, such as a pressure gage 104 or a pressure switch. Fluid pressure is then released and mandrel assembly 16 is drained. Die 34 is removed from strongback 12, mandrel assembly 16 is removed from tubular workpiece 18 and lower and upper die components 14*a* and 14*b* are separated to permit tubular workpiece 18 to be removed.

Figure 6:
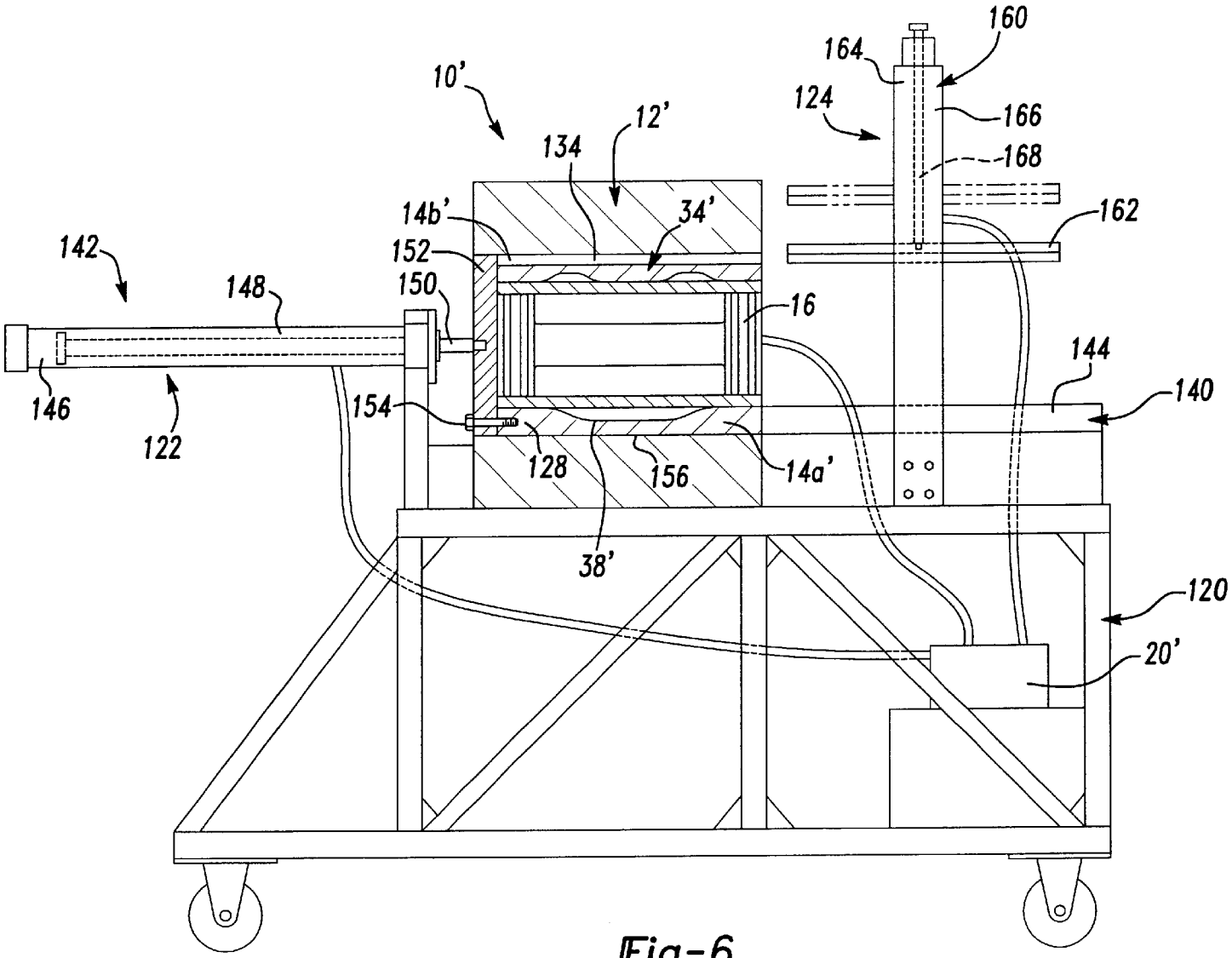
FIG. 6 is a side elevational view in partial section of a forming device constructed in accordance with another preferred embodiment of the present invention.

While the forming device 10 has been described thus far with reference to a preferred embodiment, those skilled in the art will appreciate that the invention, in its broader aspects, may be constructed somewhat differently. For example, the forming device 10' may be constructed as shown in FIG. 6. In this arrangement, forming device 10' is shown to include a cart structure 120, strongback 12', a plurality of die components 14', mandrel assembly 16, tubular workpiece 18, a source of pressurized fluid 20', die loading means 122 and die separating means 124. Cart structure 120 provides a portable base onto which the other components of forming device 10' may be mounted. Strongback 12' is similar to strongback 12 except that it has been fixedly coupled to cart structure 120. The source of pressurized fluid 20' is similar to the source of pressurized fluid 20 but is fixedly coupled to cart structure 120 and preferably also includes a low-pressure, high volume hydraulic pump.

Die components 14' are similar to die components 14 in that they include a lower die component 14*a'* and an upper die component 14*b'* that mate together to form a die 34'. Lower die component 14*a'* includes a pair of threaded retaining apertures 128 which permit die 34' to be fixedly but removably coupled to die loading means 122. Upper die component 14*b'* includes a coupling aperture 134 which permits upper die component 14*b'* to be coupled to die separating means 124. As those skilled in the art will understand, the tube profile 38' need not be symmetrical about the longitudinal axis of die 34'.

Die loading means 122 includes a support structure 140 for supporting die 34' prior to being loaded into strongback 12' and a linear drive mechanism 142 for sliding die 34' into and out of the die cavity 28 in strongback 12'. In the particular embodiment illustrated, support structure 140 is a set of ways 144 and linear drive mechanism 142 is a hydraulic cylinder 146. The set of ways 144 is coupled to cart structure 120 and configured to support die 34' such that its longitudinal axis is coincident with the longitudinal axis of die cavity 28. Hydraulic cylinder 146 is conventional in its construction and includes a housing 148, a piston (not specifically shown) and a rod 150. Housing 148 is coupled to cart structure 120 and rod 150 is coupled to an adapter 152. Bolts 154 are employed to fixedly but releasably engage the threaded retaining apertures 128 in lower die component 14*a'*. Adapter 152 is preferably sized to contact the surface 156 of die cavity 28 in at least three locations regardless of the position of rod 150 so as to improve the capability of die loading means 122 to guide die 34' into and out of die cavity 28. Hydraulic cylinder 146 receives fluid power from the low-pressure, high volume hydraulic pump of the source of pressurized fluid 20'.

Figure 7:
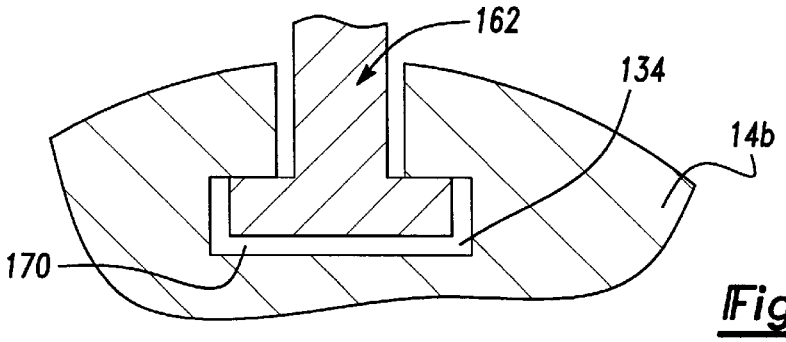
FIG. 7 is a sectional view of a portion of the forming device of FIG. 6 illustrating the adapter of the die separating means engaged with the upper die component.

In the particular embodiment illustrated, die separating means 124 includes a linear drive mechanism 160 and an adapter 162. Linear drive mechanism 160 is shown to be a conventional hydraulic cylinder 164 having a housing 166, a piston (not specifically shown) and a rod 168. Housing 166 is coupled to cart structure 120 and rod 168 is coupled to adapter 162. Adapter 162 is configured to mate with upper die component 14*b'* and as such, any coupling mechanism known in the art may be employed to releasably couple adapter 162 and upper die component 14*b'*, including threaded or non-threaded fasteners and pins. As shown in FIG. 7, upper die component 14*b'* preferably includes a groove 170 into which a portion of adapter 162 is received. In the particular embodiment illustrated, adapter 162 is generally shaped in the form of an inverted "T" which is received into a corresponding T-shaped groove 170 in upper die component 14*b'* when die loading means 122 slides die 34' onto the set of ways 144. Construction in this manner is advantageous in that upper die component 14*b'* is coupled to die separating means 124 automatically when die 34' is unloaded from strongback 12'. Hydraulic cylinder 164 receives fluid power from the low-pressure, high volume hydraulic pump of the source of pressurized fluid 20'.

Operation of forming device 10' is substantially similar to that of forming device 10, except that die separating means 124 may be actuated by the source of pressurized fluid 20' to lower and raise the upper die component 14*b'* for loading and unloading tubular workpiece 18 and die loading means 122 may be actuated by the source of pressurized fluid 20' to load die 34' to and unload die 34' from strongback 12'. Construction of forming device 10' in this manner is advantageous in that it improves the ergonomics of the workstation and the efficiency with which tubular workpiece 18 can be formed.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A forming device comprising:

a fluid source providing a pressurized fluid;

a strongback having a die cavity;

a tubular workpiece having a hollow interior;

a plurality of die components mated to form a forming die having an internal cavity with a forming portion, the forming portion of the die being entirely disposed in the die cavity of the strongback, the internal cavity being configured to correspond to a predetermined tube profile, the forming die surrounding at least a portion of the tubular workpiece; and a mandrel assembly disposed at least partially within the hollow interior of the tubular workpiece in an area proximate the die, the mandrel assembly being in sealing engagement with the hollow interior of the tubular workpiece, the mandrel assembly having at least one feed aperture in fluid connection with the fluid source, the at least one feed aperture directing the pressurized fluid against the hollow interior of the tubular workpiece to cause the tubular workpiece to expand into the internal cavity.

2. The forming device of claim 1, wherein the mandrel assembly includes an O-ring having a generally circular cross-section.

3. The forming device of claim 1, wherein a first one of the plurality of die components includes a pin member and a mating one of the plurality of die components includes a hole for receiving the pin member, the pin member and the hole cooperating to align the first one and the mating one of the plurality of die components.

4. The forming device of claim 1, wherein the die is generally cylindrically shaped.

5. The forming device of claim 1, wherein the forming device is operable for forming a bulge in the tubular workpiece.

6. The forming device of claim 1, wherein the tubular workpiece expands against the surface of the internal cavity.

7. The forming device of claim 1, further comprising a pressure measurement device for monitoring the pressure of the pressurized fluid.

8. The forming device of claim 1, wherein each of the plurality of die components includes a die member formed from aluminum.

9. A forming device comprising:

a fluid source providing a pressurized fluid;

a strongback having a die cavity;

a tubular workpiece having a hollow interior;

a plurality of die components mated to form a forming die having an internal cavity, the die being at least partially disposed in the die cavity of the strongback, the internal cavity being configured to correspond to a predetermined tube profile, the forming die surrounding at least a portion of the tubular workpiece; and a mandrel assembly disposed at least partially within the hollow interior of the tubular workpiece in an area proximate the die, the mandrel assembly being in sealing engagement with the hollow interior of the tubular workpiece, the mandrel assembly having at least one feed aperture in fluid connection with the fluid source, the at least one feed aperture directing the pressurized fluid against the hollow interior of the tubular workpiece to cause the tubular workpiece to expand into the internal cavity, the mandrel assembly including a necked-down portion through which the at least one feed aperture extends, the necked-down portion permitting the pressurized fluid to accumulate between the mandrel assembly and the tubular workpiece.

10. A forming device comprising:

a fluid source providing a pressurized fluid;

a strongback having a die cavity;

a tubular workpiece having a hollow interior;

a plurality of die components mated to form a forming die having an internal cavity, the die being at least partially disposed in the die cavity of the strongback, the internal cavity being configured to correspond to a predetermined tube profile, the forming die surrounding at least a portion of the tubular workpiece;

a mandrel assembly disposed at least partially within the hollow interior of the tubular workpiece in an area proximate the die, the mandrel assembly being in sealing engagement with the hollow interior of the tubular workpiece, the mandrel assembly having at least one feed aperture in fluid connection with the fluid source, the at least one feed aperture directing the pressurized fluid against the hollow interior of the tubular workpiece to cause the tubular workpiece to expand into the internal cavity; and a set of ways aligned to the die cavity of the strongback, the ways permitting the die to be slid axially into and out of the strongback.

11. The forming device of claim 10, further comprising a drive mechanism coupled to at least one of the plurality of die components, the drive mechanism operable in a first direction for sliding the die along the set of ways into the strongback, the drive mechanism operable in a second direction for sliding the die out of the strongback onto the ways.

12. The forming device of claim 11, further comprising a lift mechanism for lifting at least one of the plurality of die components to permit the tubular workpiece to be inserted to and withdrawn from the internal cavity of the die.

13. A method for forming a tubular workpiece having a hollow interior, the method comprising the steps of:

providing a lower die component having a die aperture;

placing the tubular workpiece into the die aperture of the lower die component;

providing an upper die component having a die aperture, the upper die component configured to mate with the lower die component such that the die apertures of the upper and lower die components form an internal cavity that is configured to correspond to a predetermined tube profile, the internal cavity having a forming portion;

placing the upper die component onto the tubular workpiece and the lower die component;

providing a mandrel assembly having a pair of spaced apart seals and at least one feed aperture;

inserting the mandrel assembly into the tubular workpiece such that the mandrel assembly is proximate the internal cavity and the spaced apart seals sealingly engage the surface of the hollow interior;

providing a strongback having a die cavity;

inserting the upper and lower die components into the die cavity of the strongback such that the forming portion of the die cavity is entirely housed within the die cavity;

supplying the mandrel assembly with a pressurized fluid, the pressurized fluid exiting the mandrel assembly from the at least one feed aperture and exerting a force against at least a portion of the hollow interior of the tubular workpiece to expand into the internal cavity.

14. The method of claim 13, wherein the step of supplying the mandrel assembly with the pressurized fluid is terminated when the pressurized fluid is maintained at a predetermined pressure.

15. The method of claim 13, further comprising the steps of:

releasing the pressurized fluid and draining the mandrel assembly;

removing the upper and lower die components from the die cavity of the strongback;

removing the mandrel assembly from the tubular workpiece; and separating the upper and lower die components.

16. The method of claim 13, wherein the upper and lower die components are clamped together prior to the step of inserting the mandrel assembly into the tubular workpiece.

17. The method of claim 13, wherein prior to the step of supplying the mandrel assembly with the pressurized fluid, residual air in the mandrel assembly and between the tubular workpiece and the mandrel assembly is purged.

18. The method of claim 13, wherein the pressurized fluid expands the at least a portion of the hollow interior of the tubular workpiece against the surface of the internal cavity.

19. A method for forming a tubular workpiece having a hollow interior, the method comprising the steps of:

providing a lower die component having a die aperture;

placing the tubular workpiece into the die aperture of the lower die component;

providing an upper die component having a die aperture, the upper die component configured to mate with the lower die component such that the die apertures of the upper and lower die components form an internal cavity that is configured to correspond to a predetermined tube profile;

placing the upper die component onto the tubular workpiece and the lower die component;

providing a mandrel assembly having a pair of spaced apart seals and at least one feed aperture;

inserting the mandrel assembly into the tubular workpiece such that the mandrel assembly is proximate the internal cavity and the spaced apart seals sealingly engage the surface of the hollow interior;

providing a strongback having a die cavity;

inserting the upper and lower die components into the die cavity of the strongback;

supplying the mandrel assembly with a pressurized fluid, the pressurized fluid exiting the mandrel assembly from the at least one feed aperture and exerting a force against at least a portion of the hollow interior of the tubular workpiece to expand into the internal cavity;

releasing the pressurized fluid and draining the mandrel assembly;

removing the upper and lower die components from the die cavity of the strongback;

removing the mandrel assembly from the tubular workpiece; and separating the upper and lower die components with a linear drive mechanism.

20. The method of claim 19, wherein the linear drive mechanism is a hydraulic cylinder.

* * * * *